US010236580B2

(12) United States Patent
Wang et al.

(10) Patent No.: US 10,236,580 B2
(45) Date of Patent: Mar. 19, 2019

(54) METHOD AND APPARATUS FOR IMPLEMENTING ANTENNA MODULARIZATION AND ANTENNA MODULE

(71) Applicant: ZTE Corporation, Shenzhen, Guangdong (CN)

(72) Inventors: Boming Wang, Shenzhen (CN); Peng Wang, Shenzhen (CN); Huanzhan Fu, Shenzhen (CN); Cheng Yang, Shenzhen (CN); Jin Zhang, Shenzhen (CN)

(73) Assignee: ZTE Corporation, Shenzhen, Guangdon (CN)

( * ) Notice: Subject to any disclaimer, the term of this patent is extended or adjusted under 35 U.S.C. 154(b) by 174 days.

(21) Appl. No.: 15/123,329

(22) PCT Filed: Sep. 1, 2014

(86) PCT No.: PCT/CN2014/085693
§ 371 (c)(1),
(2) Date: Sep. 2, 2016

(87) PCT Pub. No.: WO2015/131514
PCT Pub. Date: Sep. 11, 2015

(65) Prior Publication Data

US 2017/0104270 A1 Apr. 13, 2017

(30) Foreign Application Priority Data

Mar. 4, 2014 (CN) ..... 2014 1 0077650

(51) Int. Cl.
*H01Q 1/24* (2006.01)
*H01Q 5/40* (2015.01)
(Continued)

(52) U.S. Cl.
CPC ..... *H01Q 5/40* (2015.01); *H01Q 1/246* (2013.01); *H01Q 5/42* (2015.01); *H01Q 21/0025* (2013.01)

(58) Field of Classification Search
CPC ..... H01Q 3/24; H01Q 21/28; H01Q 1/243; H01Q 3/32; H01Q 1/20
(Continued)

(56) References Cited

U.S. PATENT DOCUMENTS 8,346,092 B2 1/2013 Zhao
2003/0038748 A1* 2/2003 Henderson ..... H01Q 1/246 342/373
(Continued)

FOREIGN PATENT DOCUMENTS

CN 1630135 A 6/2005
CN 102308437 A 1/2012
(Continued)

OTHER PUBLICATIONS

International Search Report in international application No. PCT/CN2014/085693, dated Dec. 10, 2014, 6 pgs.
(Continued)

*Primary Examiner* — Dameon E Levi
*Assistant Examiner* — Collin Dawkins
(74) *Attorney, Agent, or Firm* — Cooper Legal Group, LLC

(57) ABSTRACT

Disclosed is a method for implementing antenna modularization, comprising: dividing components of an antenna, forming antenna modules by the divided components, and setting types of the antenna modules. Also disclosed are a device for implementing antenna modularization and antenna modules.

12 Claims, 6 Drawing Sheets

(51) Int. Cl.
*H01Q 5/42* (2015.01)
*H01Q 21/00* (2006.01)

(58) Field of Classification Search
USPC ..... 343/876, 777, 904, 778
See application file for complete search history.

(56) References Cited

U.S. PATENT DOCUMENTS

| | | | | |
|---|---|---|---|---|
| 2004/0209572 | A1 | 10/2004 | Thomas | |
| 2012/0014697 | A1* | 1/2012 | Zhao | H01Q 1/246 398/115 |
| 2010/0848301 | | 6/2012 | Holland | |
| 2013/0070819 | A1 | 3/2013 | Zhao et al. | |
| 2014/0313095 | A1 | 10/2014 | Pu et al. | |

FOREIGN PATENT DOCUMENTS

| | | | |
|---|---|---|---|
| CN | 102460833 | A | 5/2012 |
| CN | 102522634 | A | 6/2012 |
| CN | 102570064 | A | 7/2012 |
| CN | 102804489 | A | 11/2012 |
| CN | 102959796 | A | 3/2013 |
| CN | 103036603 | A | 4/2013 |
| CN | 103490175 | A | 1/2014 |
| WO | 2012103831 | A2 | 8/2012 |

OTHER PUBLICATIONS

English Translation of the Written Opinion of the International Search Authority in international application No. PCT/CN2014/085693, dated Dec. 10, 2014, 14 pgs.
Supplementary European Search Report in European application No. 14884532.4, dated Feb. 10, 2017, 10 pgs.

* cited by examiner

METHOD AND APPARATUS FOR IMPLEMENTING ANTENNA MODULARIZATION AND ANTENNA MODULE

TECHNICAL FIELD

The disclosure relates to an antenna technology in the field of communications, and in particular to a method and apparatus for implementing antenna modularization, and an antenna module.

BACKGROUND

A traditional wireless network can be generally divided into a source part and an antenna feeder part, wherein the source part is a device for sending or receiving a signal; the antenna feeder part includes traditional passive antenna units; and the source part and the antenna feeder part are connected using a radio frequency cable via a standard interface.

With the diversified and broadband development trend of a mobile communication network, a user needs to flexibly configure a network according to a practical application. However, in a flexible network configuration process, the following demands exist.

(1) Demand for Integrating Various System Networks on a Same Antenna Plane

A current technology mainly refers to connecting a plurality of source parts of different systems and a plurality of antenna parts of different frequency bands so as to achieve multi-system antenna configurations, which may cause the following main problems:

- the website space and area are required, and the website cost is high;
- it is difficult to plan, upgrade or expand a network in the future;
- a network service is probably interrupted during network management and network maintenance; and
- a future development trend to broadband and multiband cannot be met.

(2) Demand for Flexibly Configuring an Active Part and a Passive Part for Each System on a Same Antenna Plane Currently, an active antenna system is a base station communication system obtained through integration of a multi-channel transceiver and a base station antenna, and an interface between an antenna part thereof and the multi-channel transceiver is an internal interface, which may cause the following main problems:

- an active part and a passive part cannot be flexibly configured, but are tightly coupled to each other, working modes being fixed;
- a combination manner between the active part and the passive part is limited;
- antenna components cannot be shared between the active part and the passive part or are shared therebetween in a limited manner;
- after network creation, a working frequency band provided by the active part and a user capacity are fixed, and it is difficult to plan, upgrade or expand a network in the future; and
- a network service is probably interrupted during network management and network maintenance.

SUMMARY

In view of this, the embodiments of the disclosure expect to provide a method and apparatus for implementing antenna modularization, and an antenna module, which can implement antenna modularization to further meet an evolution demand for integration of a passive antenna to broadband/multiband and development of an active antenna to multi-mode/broadband/miniaturization.

The technical solutions of the embodiments of the disclosure are implemented as follows.

An embodiment of the disclosure provides a method for implementing antenna modularization, which may include that:

components of an antenna are divided, an antenna module is constituted by the divided components, and the type of the antenna module is set.

In the solution, the step that the components of the antenna are divided may include that: the components of the antenna are divided into an antenna element group, a phase shifter network, a passive connector group, an active connector group, an electric tunable unit, an antenna feeder interface, an electric tunable interface, a radio frequency jumper and a combiner according to functions of respective components of the antenna.

Before the components of the antenna are divided, the method may further include that: active connectors and passive connectors in the antenna are standardized respectively.

In the solution, the step that the antenna module is constituted by the divided components may include that: the antenna element group is connected to the active connector group; a branch interface of the phase shifter network is connected to the passive connector group, a combination interface of the phase shifter network is connected to the antenna feeder interface, and the phase shifter network is connected to an external source device via the antenna feeder interface; and the electric tunable unit is connected to the phase shifter network, and the electric tunable unit is connected to an external control device via the electric tunable interface.

In the solution, the antenna module may include: an active antenna module, a passive antenna module and an active-passive mixed antenna module.

The step that the type of the antenna module is set may include that: the type of the antenna module is set as the active antenna module by connecting the active connector group to a transceiver array; the type of the antenna module is set as the passive antenna module by connecting the passive connector group to the active connector group; and the type of the antenna module is set as the active-passive mixed antenna module by connecting a first branch port of the combiner to the transceiver array, connecting a second branch port of the combiner to the passive connector group and connecting a combination port of the combiner to the active connector group.

In the solution, when the antenna supports a plurality of frequency bands, the method may further include that: the antenna is divided into more than two single-frequency band antenna modules, and a plurality of single-frequency band antenna modules is logically combined.

In the solution, the step that the plurality of single-frequency band antenna modules is logically combined may include that: the type of each single-frequency band antenna module is set, and the plurality of single-frequency band antenna modules is logically combined in various ways according to an actual networking demand.

An embodiment of the disclosure also provides an apparatus for implementing antenna modularization, which may include: a division module, a generation module and a setting module, wherein the division module is configured to divide components of an antenna;

the generation module is configured to constitute an antenna module by the divided components; and the setting module is configured to set the type of the antenna module.

In the solution, the division module may be configured to divide, according to functions of respective components of the antenna, the components of the antenna into an antenna element group, a phase shifter network, a passive connector group, an active connector group, an electric tunable unit, an antenna feeder interface, an electric tunable interface, a radio frequency jumper and a combiner.

The apparatus may further include: a standardization module, wherein the standardization module is configured to standardize active connectors and passive connectors in the antenna respectively.

In the solution, the generation module may be configured to: connect the antenna element group to the active connector group; connect a branch interface of the phase shifter network to the passive connector group, connect a combination interface of the phase shifter network to the antenna feeder interface, and connect the phase shifter network to an external source device via the antenna feeder interface; and connect the electric tunable unit to the phase shifter network, and connect the electric tunable unit to an external control device via the electric tunable interface.

In the solution, the antenna module may include: an active antenna module, a passive antenna module and an active-passive mixed antenna module.

The setting module may be configured to: set the type of the antenna module as the active antenna module by connecting the active connector group to a transceiver array; set the type of the antenna module as the passive antenna module by connecting the passive connector group to the active connector group; and set the type of the antenna module as the active-passive mixed antenna module by connecting a first branch port of the combiner to the transceiver array, connecting a second branch port of the combiner to the passive connector group and connecting a combination port of the combiner to the active connector group.

In the solution, when the antenna supports a plurality of frequency bands, the apparatus may further include: a combination module, wherein the combination module is configured to divide the antenna into more than two single-frequency band antenna modules, and logically combine a plurality of single-frequency band antenna modules.

In the solution, the combination module may be configured to set the type of each single-frequency band antenna module, and logically combine the plurality of single-frequency band antenna modules in various ways according to an actual networking demand.

Processing execution of the division module, the generation module, the setting module, the standardization module and the combination module may be implemented by a Central Processing Unit (CPU), a Digital Signal Processor (DSP) or a Field-Programmable Gate Array (FPGA).

An embodiment of the disclosure also provides an antenna module, which may include: an antenna element group, a phase shifter network, a passive connector group, an active connector group, an electric tunable unit, an antenna feeder interface, an electric tunable interface, a radio frequency jumper and a combiner.

The antenna element group may be connected to the active connector group; a branch interface of the phase shifter network may be connected to the passive connector group, a combination interface of the phase shifter network may be connected to the antenna feeder interface, and the phase shifter network may be connected to an external source device via the antenna feeder interface; and the electric tunable unit may be connected to the phase shifter network, and the electric tunable unit may be connected to an external control device via the electric tunable interface.

In the solution, when the antenna module is an active antenna module, the active connector group may be connected to a transceiver array; when the antenna module is a passive antenna module, the passive connector group may be connected to the active connector group; and when the antenna module is an active-passive mixed antenna module, a first branch port of the combiner may be connected to the transceiver array, a second branch port of the combiner may be connected to the passive connector group, and a combination port of the combiner may be connected to the active connector group.

In the solution, the antenna module may include more than two single-frequency band antenna modules.

The embodiments of the disclosure provide the method and apparatus for implementing antenna modularization, and the antenna module. Components of an antenna are divided, an antenna module is constituted by the divided components, and the type of the antenna module is set. Thus, the antenna module can be set, and a user can set the type of the antenna module as an active antenna module, a passive antenna module or an active-passive mixed antenna module according to a practical application requirement. As a result, the antenna is modularized, the modularization of the antenna enables an active antenna and a passive antenna to be decoupled, and therefore the two antennae can evolve to respective development routes. Consequently, demands for network planning, upgrading or expanding can be met.

Moreover, in the embodiments of the disclosure, when the antenna supports a plurality of frequency bands, a plurality of single-frequency band antenna modules can be logically combined in various ways according to an actual networking demand. So, the antenna can be presented as a network antenna form, such that demands for flexibly networking different frequency band antennae can be met, thereby adapting to a development trend of network flatting.

DETAILED DESCRIPTION

Figure 1:
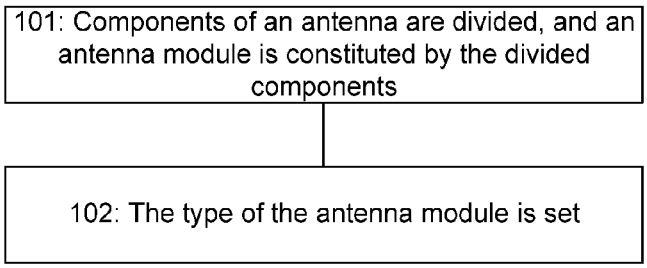
FIG. 1 is an implementation flow diagram of a method embodiment for implementing antenna modularization according to the disclosure.

In the embodiments of the disclosure, active connectors and passive connectors in an antenna are standardized respectively; all components of the antenna are divided according to functions of respective components of the antenna; and then, an antenna module is constituted by re-connecting all the divided components, and the type of the antenna module is set according to a practical application requirement.

Furthermore, when the antenna supports a plurality of frequency bands, the antenna can be divided into more than two single-frequency band antenna modules according to frequency bands, the type of each single-frequency band antenna module is set, and the plurality of single-frequency band antenna modules is logically combined in various ways according to an actual networking demand.

Wherein, standardizing the active connectors and the passive connectors in the antenna respectively may refer to: setting a unified international/national/industrial standard for materials, structures, sizes, technologies, electrical performances and the like, or setting a unified standard according to a product type, and determining the quantity and layout of the active connectors and the passive connectors on an antenna structure.

In the embodiments of the disclosure, the components of the antenna can be divided into an antenna element group, a phase shifter network, a passive connector group, an active connector group, an electric tunable unit, an antenna feeder interface, an electric tunable interface, a radio frequency jumper and a combiner according to the functions of all the components of the antenna.

Wherein, the antenna module may include: an active antenna module, a passive antenna module and an active-passive mixed antenna module. Different types of antenna modules may be obtained by connecting different components. That is, all required components and a connecting mode between all the components can be determined.

Specifically, in practical application, when the antenna module is required to be an active antenna module, the type of the antenna module can be set as the active antenna module by connecting the active connector group to a transceiver array; when the antenna module is required to be a passive antenna module, the type of the antenna module can be set as the passive antenna module by connecting the passive connector group to the active connector group; and when the antenna module is required to be an active-passive mixed antenna module, the type of the antenna module can be set as the active-passive mixed antenna module by connecting a first branch port of the combiner to the transceiver array, connecting a second branch port of the combiner to the passive connector group, and connecting a combination port of the combiner to the active connector group.

Furthermore, when the antenna supports a plurality of frequency bands, the antenna can be divided into more than two single-frequency band antenna modules according to the quantity of all the components of the antenna, the sizes thereof and a connecting relationship therebetween, the type of each single-frequency band antenna module is set according to a practical application requirement, and the plurality of single-frequency band antenna modules is logically combined in various ways according to an actual networking demand by means of reusing, internal nesting and longitudinal stacking modes.

The disclosure is further illustrated below with reference to the drawings and specific embodiments in detail.

An embodiment of the disclosure provides a method for implementing antenna modularization. FIG. 1 is an implementation flow diagram of a method embodiment for implementing antenna modularization according to the disclosure. As shown in FIG. 1, the method includes the steps as follows.

Step 101: Components of an antenna are divided, and an antenna module is constituted by the divided components.

Figure 2:
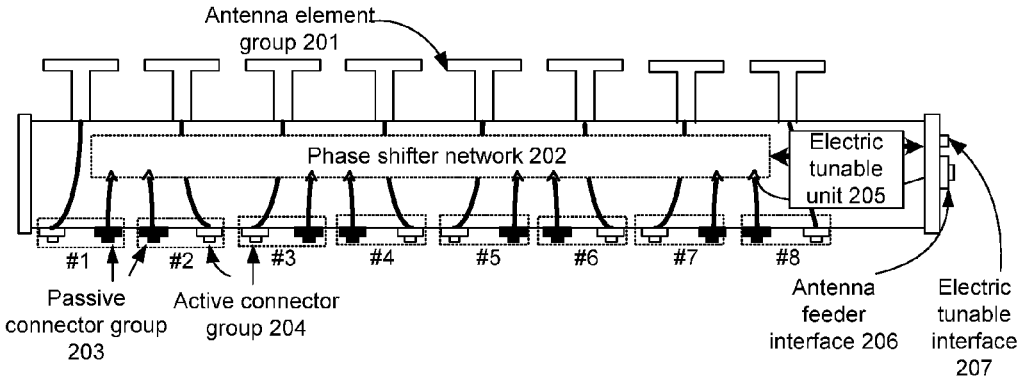
FIG. 2 is a diagram illustrating component connection of a single-frequency band eight-unit single-polarization antenna according to an embodiment of the disclosure.

A single-frequency band eight-unit single-polarization antenna is taken as an example. FIG. 2 is a diagram illustrating component connection of a single-frequency band eight-unit single-polarization antenna according to an embodiment of the disclosure. As shown in FIG. 2 and FIGS. 4*a* to 4*c*, the components of the antenna are divided into an antenna element group 201, a phase shifter network 202, a passive connector group 203, an active connector group 204, an electric tunable unit 205, an antenna feeder interface 206, an electric tunable interface 207, a radio frequency jumper 208 and a combiner 209 according to functions of respective components of the antenna.

Wherein, the antenna element group 201 is a group of metal conductors having guided and amplified electromagnetic waves, and the antenna element group 201 forms a resonance circuit configured to receive or transmit an electromagnetic signal; and the sizes of antenna elements are relevant to the wavelength of the received or transmitted electromagnetic signal, and generally speaking, the sizes of the antenna elements are approximately half of the wavelength of the received or transmitted electromagnetic signal.

The phase shifter network 202 is a group of transmission line networks capable of adjusting an electric length, a signal phase can be continuously adjusted by the phase shifter network 202, and accordingly, the change of a downtilt angle of an electromagnetic wave beam is controlled.

Specifically, the transmission characteristic of the phase shifter network 202 can be changed according to different control states, and the change of the transmission characteristic enables an output signal to generate a phase difference with respect to a reference signal. In practical application, the length or dielectric constant of a transmission line of each channel in the phase shifter network 202 can be changed generally in a mechanical control or electrical control mode, the transmission characteristic of each channel in the phase shifter network 202 can be changed by adjusting the length or dielectric constant of the transmission line, and the change of the transmission characteristic enables a signal transmitted by each channel to present a certain phase relationship. Under most conditions, transmission lines having the same physical length for different frequency signals can present different phase relationships.

The passive connector group 203 and the active connector group 204 are input/output ports of a group of radio frequency signals, wherein structurally, the passive connector group 203 and the active connector group 204 are generally located on a backboard of the antenna, and the quantity of ports at each frequency band corresponding to the passive connector group 203 or the active connector group 204 depends on a development level of an antenna technology and a network demand.

The electric tunable unit 205 communicates by means of a standard communication protocol (for instance, an Antenna Interface Standards Group (AISG) protocol), thereby controlling the phase shifter network 202 and finally achieving the aim of regulating the downtilt angle of the electromagnetic wave beam. The electric tunable unit 205 can be divided into an active electric tunable unit and a passive electric tunable unit, wherein the active electric tunable unit can respond to an external command via an automatic control system, and change a transmission state of the phase shifter network 202 via an internal motor; and the passive electric tunable unit can utilize an external machine and change the transmission state of the phase shifter network 202 via an internal mechanical linkage apparatus, thereby achieving the aim of regulating the downtilt angle of the electromagnetic wave beam.

One end of the antenna feeder interface 206 can be connected to a combination interface of the phase shifter network 202, and the other end of the antenna feeder interface 206 can be connected to an external source device, wherein the external source device is mainly configured to send or receive a signal, and the external source device may include, but is not limited to, a transceiver, a base station, a repeater, a tower top amplifier and the like in a current wireless network.

One end of the electric tunable interface 207 can be connected to the electric tunable unit 205, and the other end of the electric tunable interface 207 can be connected to an external control device, wherein the external control device may be a Remote Control Unit (RCU), one end of the RCU can be connected to the electric tunable interface 207, and the other end of the RCU can be connected to an AISG control interface of the base station or a Portable Control Unit (PCU).

The radio frequency jumper 208 is a group of radio frequency cables or connectors, and is mainly configured to connect all the components or short-circuit the antenna.

The combiner 209 is a device for signal combination or power division. The combiner 209 is provided with two branch ports (a first branch port and a second branch port), and a combination port, wherein the first branch port can be connected to an output/input end of a transceiver array, the second branch port can be connected to the passive connector group 203, the combination port can be connected to the active connector group 204, and the combiner can be implemented in a form of a micro-strip printed circuit board or a cavity filter.

In the step, before the components of the antenna are divided, the method further includes that: active connectors and passive connectors in the antenna are standardized respectively.

Specifically, external interfaces of the antenna are mainly expressed as four classes of interfaces namely an active connector, a passive connector, an antenna feeder interface and an electric tunable interface. Since the four classes of interfaces corresponding to antennae in different application occasions are different only in quantity and layout, the four classes of interfaces can be standardized.

Currently, the antenna feeder interface and the electric tunable interface have been standardized. For instance, the antenna feeder interface of a base station antenna adopts a 7/16DIN-Female connector, and the electric tunable interface adopts a standard AISG interface. Consequently, it is also necessary to standardize the active connectors and the passive connectors in the antenna respectively. The standardization of the active connectors and the passive connectors provides guarantee for a mutual replaceability test and Interoperability Test (IOT) of a plurality of manufacturer devices. Meanwhile, under the condition of no interruption of original services, the active/passive antenna module can be upgraded and maintained on line.

Figure 3:
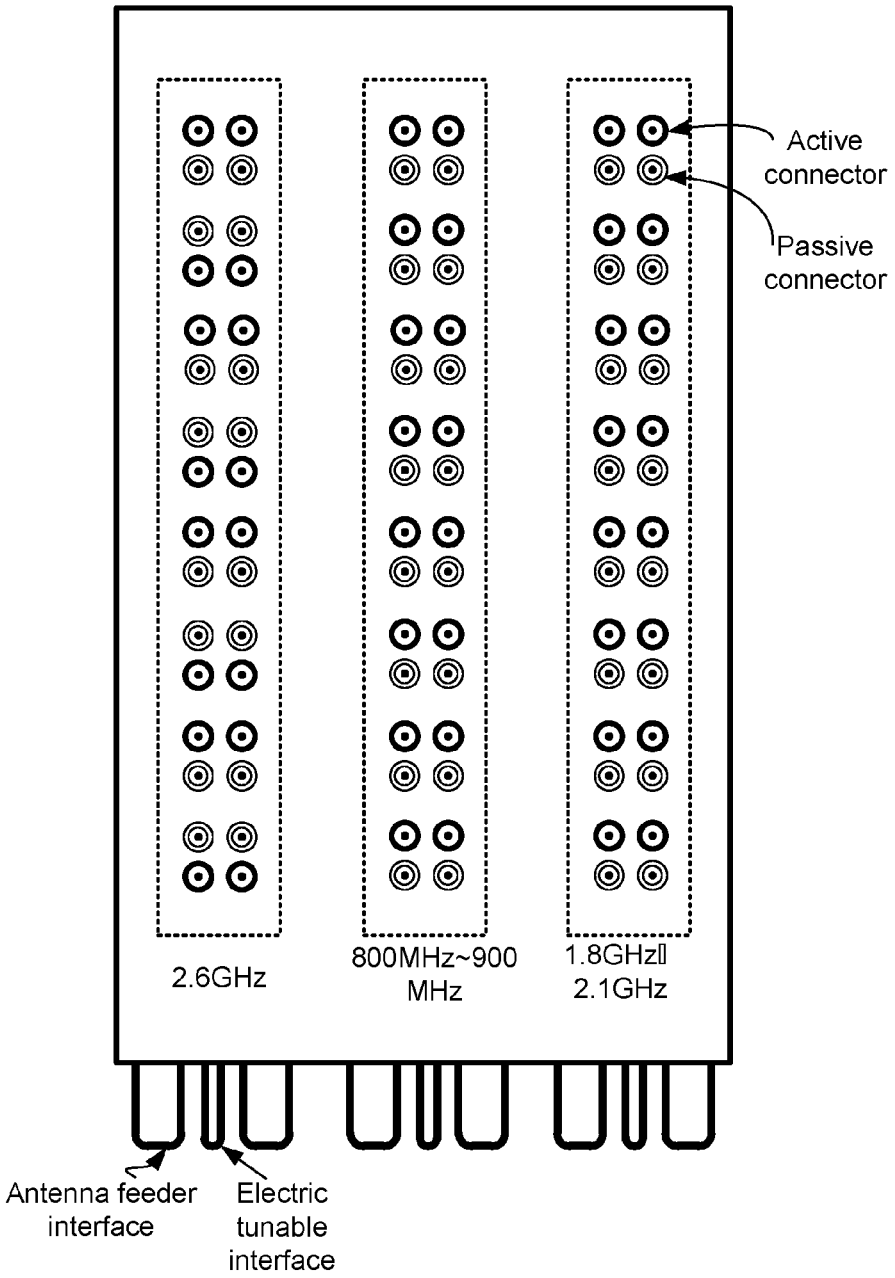
FIG. 3 is a diagram illustrating standardization of a three-frequency band eight-unit double-polarization antenna according to an embodiment of the disclosure.

A three-frequency band eight-unit double-polarization antenna is taken as an example. FIG. 3 is a diagram illustrating standardization of a three-frequency band eight-unit double-polarization antenna according to an embodiment of the disclosure. As shown in FIG. 3, three frequency bands may be: 800 MHz-900 MHz, 1.8 GHz-2.1 GHz and 2.6 GHz. It is important to note that the 800 MHz-900 MHz, the 1.8 GHz-2.1 GHz and the 2.6 GHz are only configured to distinguish different frequency bands, and do not form limits to the disclosure.

The standardization of active connectors and passive connectors in the antenna respectively is mainly embodied in: setting a unified international/national/industrial standard for materials, structures, sizes, technologies, electrical performances and the like, or setting a unified standard according to a product type, and determining the quantity and layout of the active connectors and the passive connectors on an antenna structure. Furthermore, the standardization of other interfaces in the antenna can be embodied in: the standardization of shapes, materials, volumes, weights, quantities, connecting modes and connectors.

In the step, constituting the antenna module by the divided components includes: firstly, disconnecting an interface between an antenna element group 201 and a phase shifter network 202 physically; then, connecting the antenna element group 201 to an active connector group 204; connecting a branch interface of the phase shifter network 202 to a passive connector group 203, connecting a combination interface of the phase shifter network to an antenna feeder interface 206, and connecting the phase shifter network 202 to an external source device via the antenna feeder interface 206; and connecting an electric tunable unit 205 to the phase shifter network 202, and connecting the electric tunable unit 205 to an external control device via an electric tunable interface 207.

Step 102: The type of the antenna module is set.

Wherein, the antenna module includes: an active antenna module, a passive antenna module and an active-passive mixed antenna module.

In practical application, when different types of antenna modules are required, different types of antenna modules can be obtained by connecting components of different antennae.

In the step, when the antenna module is required to be an active antenna module, the type of the antenna module is set as the active antenna module.

Figure 4A:
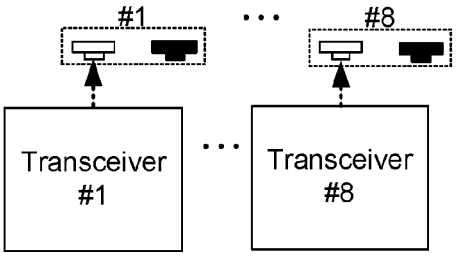
FIGS. 4*a* to 4*c* are diagrams illustrating that a single-frequency band eight-unit single-polarization antenna is set as an active antenna module, a passive antenna module or an active-passive mixed antenna module according to an embodiment of the disclosure.

Specifically, FIG. 4*a* is a diagram illustrating that a single-frequency band eight-unit single-polarization antenna is set as an active antenna module according to an embodiment of the disclosure. As shown in FIG. 4*a*, when the antenna module is required to be the active antenna module, interfaces of an active connector group 204 (#1-#8) are connected to interfaces of a transceiver array (#1-#8) in sequence. In this case, a passive connector group 203 (#1-#8) is in a disconnected state. Thus, the type of the antenna module is set as the active antenna module.

When the antenna module is required to be a passive antenna module, the type of the antenna module is set as the passive antenna module.

Figure 4B:
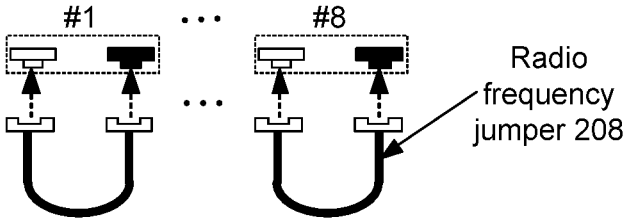

Specifically, FIG. 4*b* is a diagram illustrating that a single-frequency band eight-unit single-polarization antenna is set as a passive antenna module according to an embodiment of the disclosure. As shown in FIG. 4*b*, when the antenna module is required to be the passive antenna module, interfaces of the passive connector group 203 (#1-#8) are connected to the interfaces of the active connector group 204 (#1-#8) in sequence. In this case, the antenna element group 201 and the phase shifter network 202 are conducted. Thus, the type of the antenna module is set as the passive antenna module. Here, the active connector group and the passive connector group are connected via the radio frequency jumper 208.

When the antenna module is required to be an active-passive mixed antenna module, the type of the antenna module is set as the active-passive mixed antenna module.

Figure 4C:
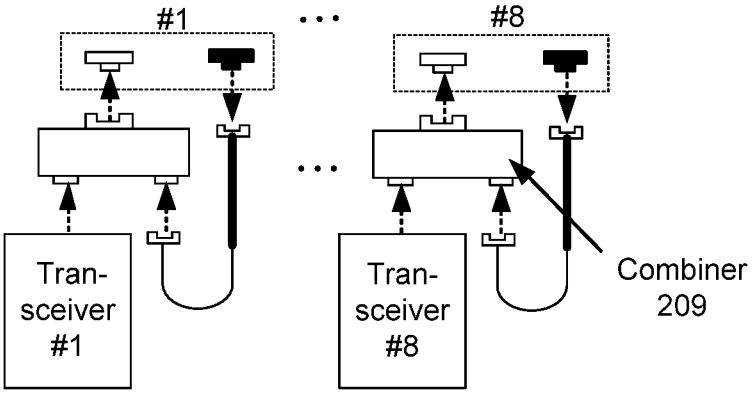

Specifically, FIG. 4*c* is a diagram illustrating that a single-frequency band eight-unit single-polarization antenna is set as an active-passive mixed antenna module according to an embodiment of the disclosure. As shown in FIG. 4*c*, when the antenna module is required to be the active-passive mixed antenna module, a first branch port of the combiner 209 is connected to a transceiver array, and a second branch port of the combiner 209 is connected to the passive connector group 203, such that a signal of an external source device, transmitted from the antenna feeder interface 207 via the phase shifter network 202, is combined with a signal of the transceiver array from the first branch port of the combiner 209. Then, a combination port of the combiner 209 is connected to the active connector group 204, such that the combined signals are transmitted to the antenna element group 201. Under general conditions, two paths of combined signals are separated from each other in frequency. The two paths of signals include: a signal from the external source device connected to the antenna feeder interface 207, and a signal from the transceiver array connected to the first branch port of the combiner 209. Thus, the type of the antenna module is set as the active-passive mixed antenna module.

Furthermore, when the antenna supports a plurality of frequency bands, the method in FIG. 1 may further include that: the antenna is divided into more than two single-frequency band antenna modules, and a plurality of single-frequency band antenna modules is logically combined.

Specifically, when the antenna supports a plurality of frequency bands, the antenna is divided into more than two single-frequency band antenna modules in accordance with the frequency bands according to the quantity of all components of the antenna, the sizes thereof and a connecting relationship therebetween, the type of each single-frequency band antenna module is set according to a practical application requirement, and the plurality of single-frequency band antenna modules is logically combined in various ways according to an actual networking demand by means of reusing, internal nesting and longitudinal stacking modes.

Figure 5:
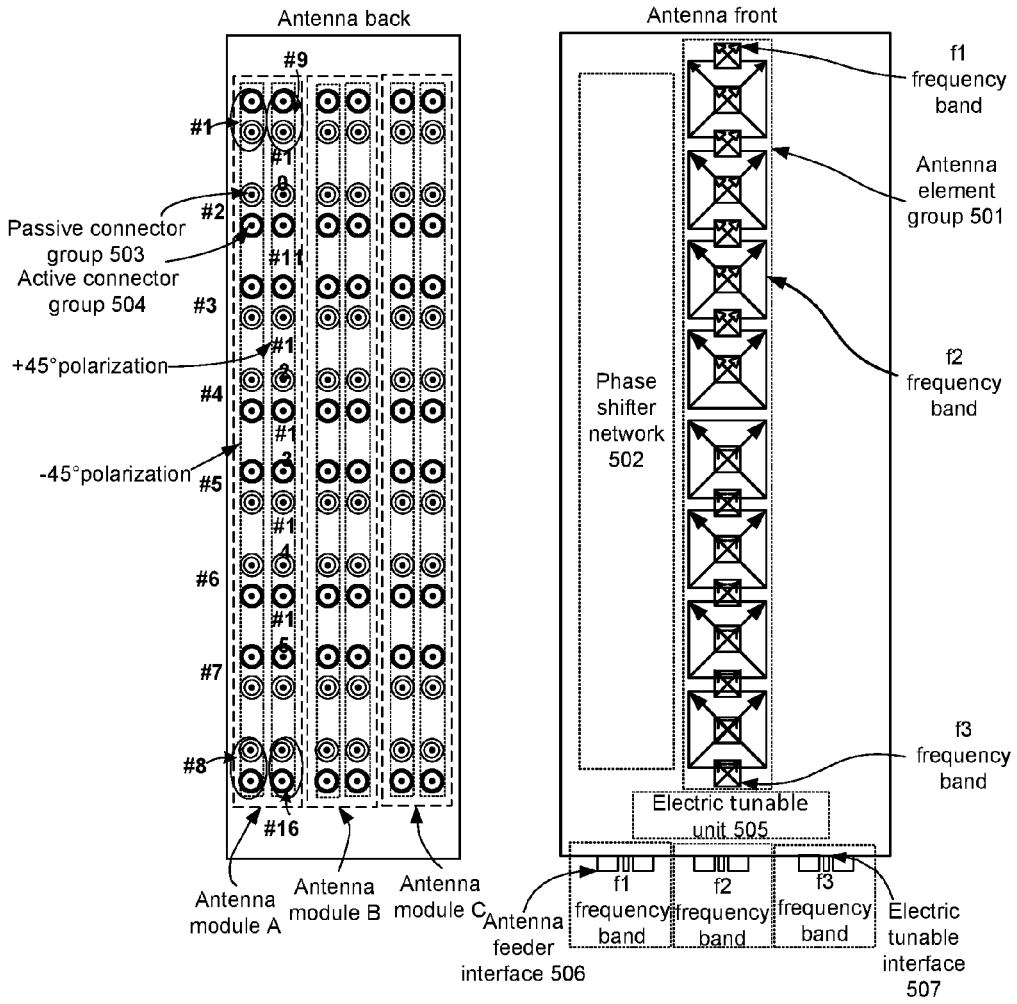
FIG. 5 is a composition structure diagram of a three-frequency band eight-unit double-polarization antenna according to an embodiment of the disclosure.

A three-frequency band eight-unit double-polarization antenna is taken as an example. FIG. 5 is a composition structure diagram of a three-frequency band eight-unit double-polarization antenna according to an embodiment of the disclosure. As shown in FIG. 5 and FIGS. 6*a* to 6*c*, the antenna may support three frequency bands namely f1 (800 MHz-900 MHz), f2 (1.8 GHz-2.1 GHz) and f3 (2.6 GHz). Similarly, components of the antenna are divided into an antenna element group 501, a phase shifter network 502, a passive connector group 503, an active connector group 504, an electric tunable unit 505, an antenna feeder interface 506, an electric tunable interface 507, a radio frequency jumper 508 and a combiner 509 according to functions of respective components of the antenna. Here, the structures and functions of all the components are similar to those of all the components shown in FIG. 2. It is important to note that the f1 (800 MHz-900 MHz), the f2 (1.8 GHz-2.1 GHz) and the f3 (2.6 GHz) are only configured to distinguish different frequency bands, and do not form limits to the disclosure.

Specifically, the antenna is divided into an antenna module A, an antenna module B and an antenna module C in accordance with the frequency bands according to the quantity of all the components of the antenna, the sizes thereof and a connecting relationship therebetween, wherein the antenna module A can support a frequency band of 800 MHz-900 MHz, the antenna module B can support a frequency band of 1.8 GHz-2.1 GHz, and the antenna module C can support a frequency band of 2.6 GHz. The antenna element group 501 at the front of the antenna is divided into three arrangements in accordance with the three frequency bands, the passive connector group 503 and the active connector group 504 are arranged at the back of the antenna, the antenna is internally provided with the phase shifter network 502 and the electric tunable unit 505, and the lower end of the antenna is provided with the antenna feeder interface 506 and the electric tunable interface 507.

The antenna module A, the antenna module B and the antenna module C can be set as an active antenna module, a passive antenna module or an active-passive mixed antenna module according to an actual requirement. It is important to note that the antenna module A, the antenna module B and the antenna module C are only configured to distinguish different antenna modules, and do not form limits to the disclosure.

The antenna module A is taken as an example. The process of setting the antenna module A as an active antenna module, a passive antenna module or an active-passive mixed antenna module is as follows.

Figure 6A:
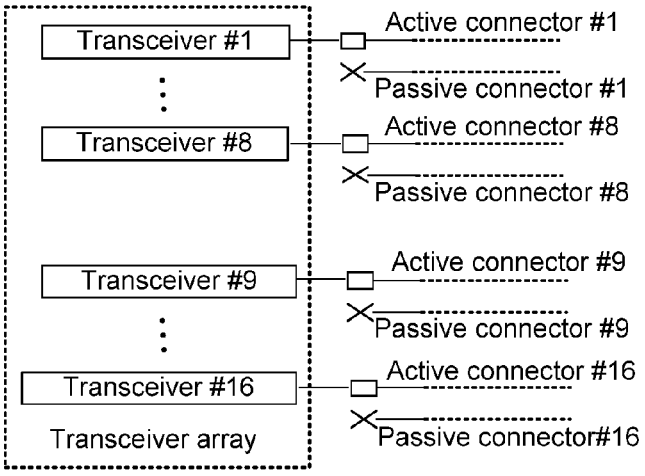
FIGS. 6*a* to 6*c* are diagrams illustrating that a single-frequency band eight-unit double-polarization antenna is set as an active antenna module, a passive antenna module or an active-passive mixed antenna module according to an embodiment of the disclosure.

FIG. 6*a* is a diagram illustrating that a single-frequency band eight-unit double-polarization antenna is set as an active antenna module according to an embodiment of the disclosure. Similar to the process of setting the single-frequency band eight-unit single-polarization antenna as the active antenna module shown in FIG. 4*a*, interfaces of an active connector group 504 (#1-#8) are connected to interfaces of a transceiver array (#1-#8) in sequence. In this case, a passive connector group 503 (#1-#8) is in a disconnected state. Thus, the type of the antenna module A is set as the active antenna module.

Figure 6B:
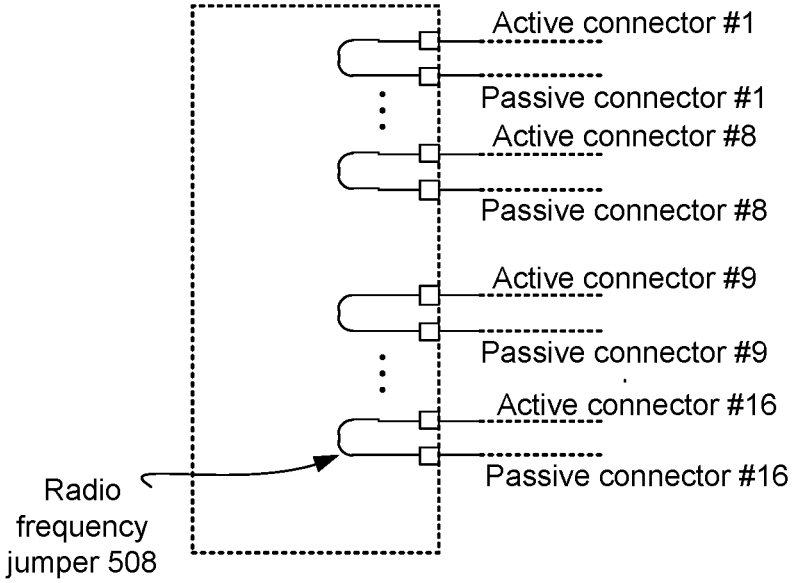

FIG. 6*b* is a diagram illustrating that a single-frequency band eight-unit double-polarization antenna is set as a passive antenna module according to an embodiment of the disclosure. Similar to the process of setting the single-frequency band eight-unit single-polarization antenna as the passive antenna module shown in FIG. 4*b*, interfaces of the passive connector group 503 (#1-#8) are connected to the interfaces of the active connector group 504 (#1-#8) in sequence. In this case, the antenna element group 501 and the phase shifter network 502 are conducted. Thus, the type of the antenna module A is set as the passive antenna module. Here, the active connector group and the passive connector group are connected via the radio frequency jumper 508.

Figure 6C:
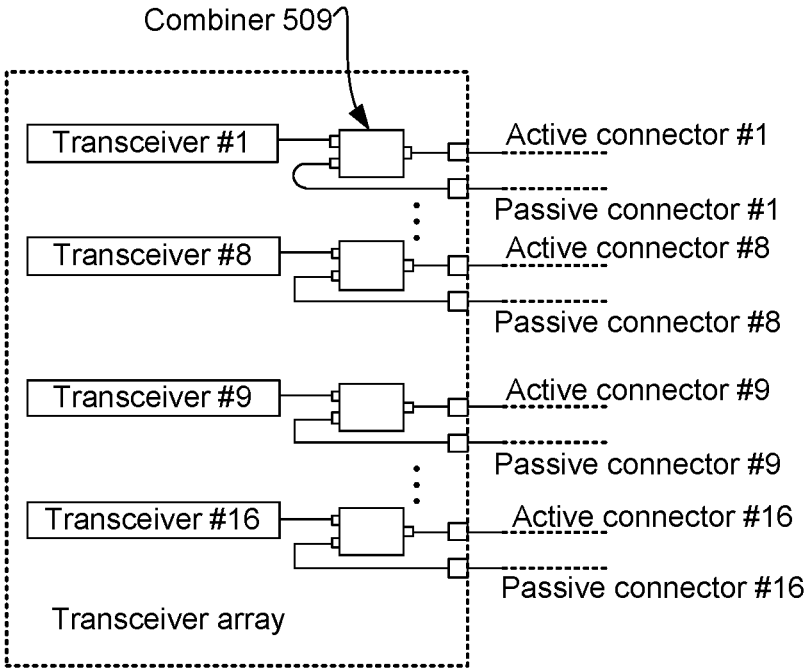

FIG. 6*c* is a diagram illustrating that a single-frequency band eight-unit double-polarization antenna is set as an active-passive mixed antenna module according to an embodiment of the disclosure. Similar to the process of setting the single-frequency band eight-unit single-polarization antenna as the active-passive mixed antenna module shown in FIG. 4*c*, a first branch port of the combiner 509 is connected to a transceiver array, and a second branch port of the combiner 509 is connected to the passive connector group 503, such that a signal of an external source device, transmitted from the antenna feeder interface 507 via the phase shifter network 502, is combined with a signal of the transceiver array from the first branch port of the combiner 509. Then, a combination port of the combiner 509 is connected to the active connector group 504, such that the combined signals are transmitted to the antenna element group 501. Under general conditions, two paths of combined signals are separated from each other in frequency. The two paths of signals include: a signal from the external source device connected to the antenna feeder interface 507, and a signal from the transceiver array connected to the first branch port of the combiner 509. Thus, the type of the antenna module A is set as the active-passive mixed antenna module.

Here, the process of setting the antenna module B and the antenna module C as an active antenna module, a passive antenna module or an active-passive mixed antenna module respectively is similar to the process of setting the antenna module A, which will not be elaborated herein.

Herein, after the types of the antenna module A, the antenna module B and the antenna module C are set, the antenna module A and/or the antenna module B and/or the antenna module C are logically combined in various ways according to an actual networking demand by means of reusing, internal nesting and longitudinal stacking modes. Since the antenna module A, the antenna module B and the antenna module C support different frequency bands respectively, the antenna can cover a plurality of frequency bands while being modularized by logically combining the antenna module A, the antenna module B and the antenna module C in various ways.

Figure 7:
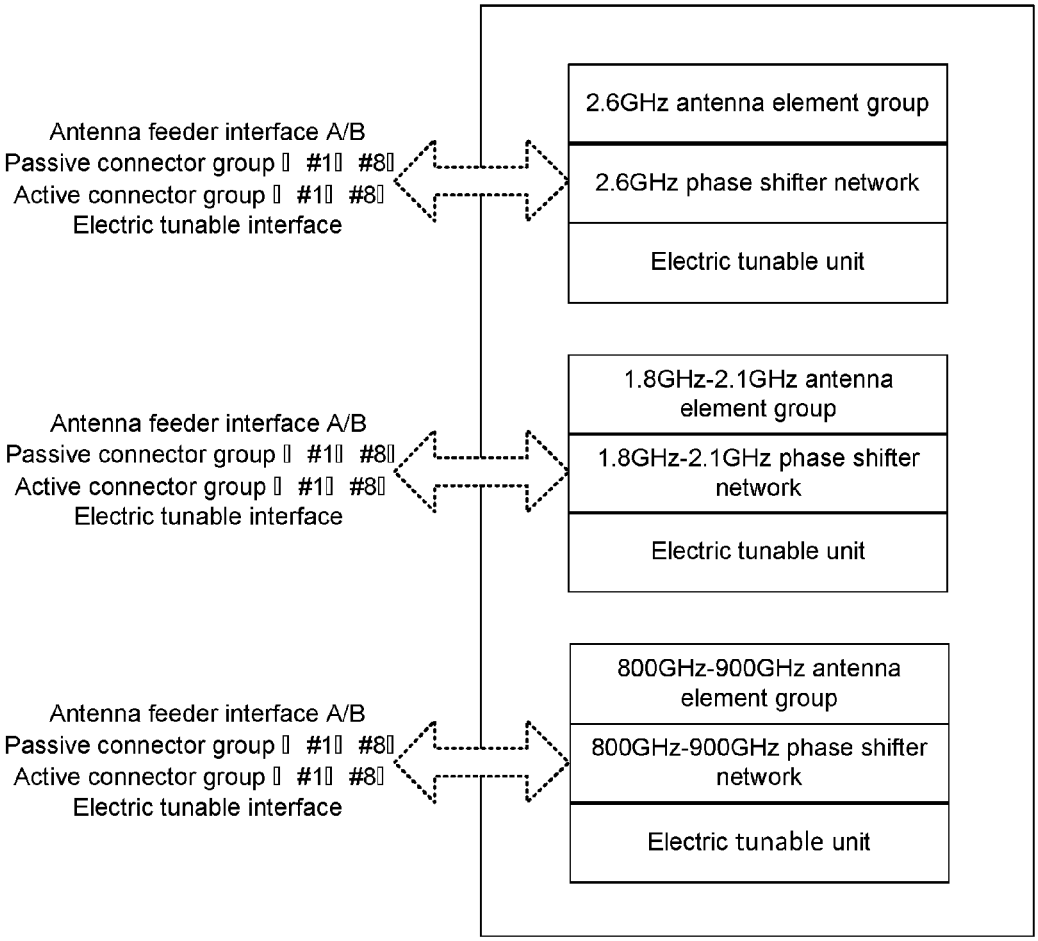
FIG. 7 is a diagram illustrating modularization of a three-frequency band eight-unit double-polarization antenna according to an embodiment of the disclosure.

FIG. 7 is a diagram illustrating modularization of a three-frequency band eight-unit double-polarization antenna according to an embodiment of the disclosure. Herein, three frequency bands are f1, f2 and f3 shown in FIG. 5, respectively. When frequency bands supported by the antenna are different, all components of the antenna are different in quantity and size. Consequently, one antenna can be constituted by antenna modules at a plurality of frequency bands, and the quantity of the antenna modules integrated inside the antenna depends on a development level of a wireless technology. When there are more antenna modules integrated inside the antenna, there are more active antenna modules, passive antenna modules and active-passive mixed antenna modules which can be set in the antenna, accordingly, and therefore there are more frequency bands supported by the antenna.

Figure 8:
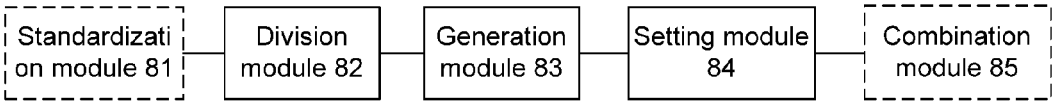
FIG. 8 is a composition structure diagram of an apparatus embodiment for implementing antenna modularization according to the disclosure.

An embodiment of the disclosure provides an apparatus for implementing antenna modularization. FIG. 8 is a composition structure diagram of an apparatus embodiment for implementing antenna modularization according to the disclosure. As shown in FIG. 8, the apparatus includes: a division module 82, a generation module 83 and a setting module 84, in which:

the division module 82 is configured to divide components of an antenna; and specifically, the division module 82 is configured to divide, according to functions of respective components of the antenna, the components of the antenna into an antenna element group, a phase shifter network, a passive connector group, an active connector group, an electric tunable unit, an antenna feeder interface, an electric tunable interface, a radio frequency jumper and a combiner.

Furthermore, the apparatus further includes: a standardization module 81, configured to standardize active connectors and passive connectors in the antenna respectively.

The generation module 83 is configured to constitute an antenna module by the divided components; and specifically, the generation module 83 is configured to: connect the antenna element group to the active connector group; connect a branch interface of the phase shifter network to the passive connector group, connect a combination interface of the phase shifter network to the antenna feeder interface, and connect the phase shifter network to an external source device via the antenna feeder interface; and connect the electric tunable unit to the phase shifter network, and connect the electric tunable unit to an external control device via the electric tunable interface.

The setting module 84 is configured to set the type of the antenna module, herein, the antenna module includes: an active antenna module, a passive antenna module and an active-passive mixed antenna module; and specifically, the setting module 84 is configured to: set the type of the antenna module as the active antenna module by connecting the active connector group to a transceiver array; set the type of the antenna module as the passive antenna module by connecting the passive connector group to the active connector group; and set the type of the antenna module as the active-passive mixed antenna module by connecting a first branch port of the combiner to the transceiver array, connecting a second branch port of the combiner to the passive connector group and connecting a combination port of the combiner to the active connector group.

Furthermore, when the antenna supports a plurality of frequency bands, the apparatus further includes: a combination module 85 configured to divide the antenna into more than two single-frequency band antenna modules, and logically combine a plurality of single-frequency band antenna modules; and specifically, the combination module 85 is configured to set the type of each single-frequency band antenna module, and logically combine the plurality of single-frequency band antenna modules in various ways according to an actual networking demand.

Figure 9:
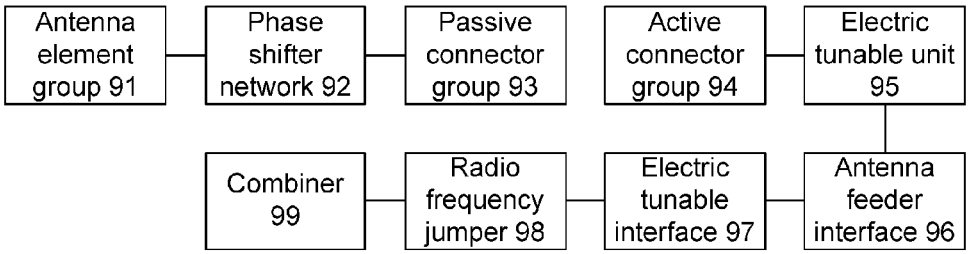
FIG. 9 is a composition structure diagram of an antenna module according to an embodiment of the disclosure.

An embodiment of the disclosure provides an antenna module. FIG. 9 is a composition structure diagram of an antenna module according to an embodiment of the disclosure. As shown in FIG. 9, the antenna module includes: an antenna element group 91, a phase shifter network 92, a passive connector group 93, an active connector group 94, an electric tunable unit 95, an antenna feeder interface 96, an electric tunable interface 97, a radio frequency jumper 98 and a combiner 99, in which:

the antenna element group 91 is connected to the active connector group 94; a branch interface of the phase shifter network 92 is connected to the passive connector group 93, a combination interface of the phase shifter network 92 is connected to the antenna feeder interface 96, and the phase shifter network is connected to an external source device via the antenna feeder interface 96; and the electric tunable unit 95 is connected to the phase shifter network 92, and the electric tunable unit 95 is connected to an external control device via the electric tunable interface 97.

Furthermore, when the antenna module is an active antenna module, the active connector group 94 is connected to a transceiver array;

when the antenna module is a passive antenna module, the passive connector group 93 is connected to the active connector group 94 via the radio frequency jumper 98; and when the antenna module is an active-passive mixed antenna module, a first branch port of the combiner 99 is connected to the transceiver array, a second branch port of the combiner 99 is connected to the passive connector group 93, and a combination port of the combiner 99 is connected to the active connector group 94.

The antenna module includes more than two single-frequency band antenna modules.

If the method for implementing antenna modularization in the embodiments of the disclosure is implemented in a form of a software function module and is sold or used as an independent product, the product may also be stored in a computer readable storage medium. Based on this understanding, those skilled in the art shall understand that the embodiments of the disclosure may be provided as a method, a system or a computer program product. Thus, forms of complete hardware embodiments, complete software embodiments or embodiments integrating software and hardware may be adopted in the disclosure. Moreover, a form of the computer program product implemented on one or more computer available storage media containing computer available program codes may be adopted in the disclosure. The storage media include, but are not limited to, a U disk, a mobile hard disk, a Read-Only Memory (ROM), a magnetic disk memory, a CD-ROM, an optical memory and the like.

The disclosure is described with reference to flowcharts and/or block diagrams of the method, the apparatus and the computer program product according to the embodiments of the disclosure. It will be appreciated that each flow and/or block in the flowcharts and/or the block diagrams and combination of the flows and/or the blocks in the flowcharts and/or the block diagrams may be implemented by computer program instructions. These computer program instructions may be provided for a general computer, a dedicated computer, an embedded processor or processors of other programmable data processing devices to generate a machine, such that an apparatus for implementing functions designated in one or more flows of the flowcharts and/or one or more blocks of the block diagrams is generated via instructions executed by the computers or the processors of the other programmable data processing devices.

These computer program instructions may also be stored in a computer readable memory capable of guiding the computers or the other programmable data processing devices to work in a specific mode, such that a manufactured product including an instruction apparatus is generated via the instructions stored in the computer readable memory, and the instruction apparatus implements the functions designated in one or more flows of the flowcharts and/or one or more blocks of the block diagrams.

These computer program instructions may also be loaded to the computers or the other programmable data processing devices, such that processing implemented by the computers is generated by executing a series of operation steps on the computers or the other programmable devices, and therefore the instructions executed on the computers or the other programmable devices provide a step of implementing the functions designated in one or more flows of the flowcharts and/or one or more blocks of the block diagrams.

Correspondingly, an embodiment of the disclosure also provides a computer storage medium. A computer program is stored therein and is configured to execute the method for implementing antenna modularization in the method embodiment of the disclosure.

The above is only the preferred embodiments of the disclosure and is not used to limit the protective scope of the disclosure.

INDUSTRIAL APPLICABILITY

The embodiments of the disclosure provide a method and apparatus for implementing antenna modularization, and an antenna module. Components of an antenna are divided, an antenna module is constituted by the divided components, and the type of the antenna module is set. Thus, the antenna module can be set, and a user can set the type of the antenna module as an active antenna module, a passive antenna module or an active-passive mixed antenna module according to a practical application requirement. As a result, the antenna is modularized, the modularization of the antenna enables an active antenna and a passive antenna to be decoupled, and therefore the two antennae can evolve to respective development routes. Consequently, demands for network planning, upgrading or expanding can be met.

What is claimed is:

1. A method for implementing antenna modularization, comprising:

dividing components of an antenna, constituting an antenna module by the divided components, and setting the type of the antenna module, wherein dividing the components of the antenna comprises: dividing, according to functions of respective components of the antenna, the components of the antenna into an antenna element group, a phase shifter network, a passive connector group, an active connector group, an electric tunable unit, an antenna feeder interface, an electric tunable interface, a radio frequency jumper and a combiner; and before the components of the antenna are divided, the method further comprises: standardizing active connectors and passive connectors in the antenna respectively, wherein constituting the antenna module by the divided components comprises: connecting the antenna element group to the active connector group; connecting a branch interface of the phase shifter network to the passive connector group, connecting a combination interface of the phase shifter network to the antenna feeder interface, and connecting the phase shifter network to an external source device via the antenna feeder interface; and connecting the electric tunable unit to the phase shifter network, and connecting the electric tunable unit to an external control device via the electric tunable interface.

2. The method according to claim 1, wherein the antenna module comprises: an active antenna module, a passive antenna module and an active-passive mixed antenna module; and setting the type of the antenna module comprises: setting the type of the antenna module as the active antenna module by connecting the active connector group to a transceiver array; setting the type of the antenna module as the passive antenna module by connecting the passive connector group to the active connector group; and setting the type of the antenna module as the active-passive mixed antenna module by connecting a first branch port of the combiner to the transceiver array, connecting a second branch port of the combiner to the passive connector group and connecting a combination port of the combiner to the active connector group.

3. The method according to claim 2, wherein when the antenna supports a plurality of frequency bands, the method further comprises: dividing the antenna into more than two single-frequency band antenna modules, and logically combining a plurality of single-frequency band antenna modules.

4. The method according to claim 3, wherein logically combining the plurality of single-frequency band antenna modules comprises: setting the type of each single-frequency band antenna module, and logically combining the plurality of single-frequency band antenna modules in various ways according to an actual networking demand.

5. The method according to claim 1, wherein when the antenna supports a plurality of frequency bands, the method further comprises: dividing the antenna into more than two single-frequency band antenna modules, and logically combining a plurality of single-frequency band antenna modules.

6. The method according to claim 5, wherein logically combining the plurality of single-frequency band antenna modules comprises: setting the type of each single-frequency band antenna module, and logically combining the plurality of single-frequency band antenna modules in various ways according to an actual networking demand.

7. An apparatus for implementing antenna modularization, comprising:

a memory storing processor-executable instructions; and a processor arranged to execute the stored processor-executable instructions to perform steps of:

dividing components of an antenna;

constituting an antenna module by the divided components;

setting the type of the antenna module, wherein dividing the components of the antenna comprises: dividing, according to functions of respective components of the antenna, the components of the antenna into an antenna element group, a phase shifter network, a passive connector group, an active connector group, an electric tunable unit, an antenna feeder interface, an electric tunable interface, a radio frequency jumper and a combiner; and before the components of the antenna are divided, standardizing active connectors and passive connectors in the antenna respectively, wherein constituting the antenna module by the divided components comprises: connecting the antenna element group to the active connector group; connecting a branch interface of the phase shifter network to the passive connector group, connecting a combination interface of the phase shifter network to the antenna feeder interface, and connecting the phase shifter network to an external source device via the antenna feeder interface; and connecting the electric tunable unit to the phase shifter network, and connecting the electric tunable unit to an external control device via the electric tunable interface.

8. The apparatus according to claim 7, wherein the antenna module comprises: an active antenna module, a passive antenna module and an active-passive mixed antenna module; and setting the type of the antenna module comprises: setting the type of the antenna module as the active antenna module by connecting the active connector group to a transceiver array; setting the type of the antenna module as the passive antenna module by connecting the passive connector group to the active connector group; and setting the type of the antenna module as the active-passive mixed antenna module by connecting a first branch port of the combiner to the transceiver array, connecting a second branch port of the combiner to the passive connector group and connecting a combination port of the combiner to the active connector group.

9. The apparatus according to claim 8, wherein when the antenna supports a plurality of frequency bands, the processor is arranged to execute the stored processor-executable instructions to further perform a step of: dividing the antenna into more than two single-frequency band antenna modules, and logically combining a plurality of single-frequency band antenna modules.

10. The apparatus according to claim 9, wherein logically combining the plurality of single-frequency band antenna modules comprises: setting the type of each single-frequency band antenna module, and logically combining the plurality of single-frequency band antenna modules in various ways according to an actual networking demand.

11. The apparatus according to claim 7, wherein when the antenna supports a plurality of frequency bands, the processor is arranged to execute the stored processor-executable instructions to further perform a step of: dividing the antenna into more than two single-frequency band antenna modules and logically combining a plurality of single-frequency band antenna modules.

12. The apparatus according to claim 11, wherein logically combining the plurality of single-frequency band antenna modules comprises: setting the type of each single-frequency band antenna module, and logically combining the plurality of single-frequency band antenna modules in various ways according to an actual networking demand.

* * * * *